US007108193B2

(12) United States Patent
Ieda

(10) Patent No.: US 7,108,193 B2
(45) Date of Patent: Sep. 19, 2006

(54) INTEGRATION OF A THERMOSTAT IN THE RECYCLING SYSTEM OF THE VEHICULAR EXHAUST GAS RECIRCULATION (EGR) SYSTEM

(75) Inventor: João José Cardinali Ieda, Vila Independencia (BR)

(73) Assignee: Wahler Metalurgica Ltda, Piracicaba SP (BR)

( * ) Notice: Subject to any disclaimer, the term of this patent is extended or adjusted under 35 U.S.C. 154(b) by 0 days.

(21) Appl. No.: 10/747,329

(22) Filed: Dec. 29, 2003

(65) Prior Publication Data

US 2005/0145228 A1 Jul. 7, 2005

(51) Int. Cl.
*F01P 7/16* (2006.01)

(52) U.S. Cl. ..... 236/34.5; 236/96 R; 123/568.12

(58) Field of Classification Search ..... 236/101 C, 236/101 D, 102, 103, 34.5, 93 R; 137/468; 123/568.12
See application file for complete search history.

(56) References Cited

U.S. PATENT DOCUMENTS 2,584,877 A * 2/1952 Hoffman et al. ..... 123/196 AB
4,175,697 A * 11/1979 Dreibelbis ..... 236/93 A
4,178,898 A * 12/1979 Akado et al. ..... 123/556
4,190,198 A * 2/1980 Casuga et al. ..... 236/34.5
4,358,051 A * 11/1982 Hunt ..... 236/34.5
4,512,300 A * 4/1985 DeVore et al. ..... 123/196 AB
4,846,617 A * 7/1989 Ehrhardt ..... 417/187
5,791,557 A * 8/1998 Kunze ..... 236/34.5
6,012,550 A * 1/2000 Lee ..... 184/6.22
6,112,706 A * 9/2000 Heer ..... 123/41.1
6,386,150 B1 * 5/2002 Iwaki ..... 123/41.1
D490,141 S * 5/2004 Pelletz et al. ..... D23/233

* cited by examiner

*Primary Examiner*—Stephen K. Cronin
*Assistant Examiner*—Arnold Castro
(74) *Attorney, Agent, or Firm*—William J. Sapone; Coleman Sudol Sapone P.C.

(57) ABSTRACT

The invention relates to the control of the temperature of recirculated exhaust gas and oil, by means of the placement of a thermostat between an oil/water heat exchanger and a water/exhaust gas exchanger. The thermostat comprises a multifaceted casing (1), in which there is a tubular portion (2) having access to a chamber (7); and, at the bottom of the chamber (7), there is a smaller diameter by-pass passage (11), through which the chamber is linked to a connection duct (12) having access to the output channel (13) that is projected along the tubular projection (14), wherein the thermostatic valve is integrated to the casing (1) by being placed inside the chamber (7), along the tubular portion (2).

7 Claims, 10 Drawing Sheets

INTEGRATION OF A THERMOSTAT IN THE RECYCLING SYSTEM OF THE VEHICULAR EXHAUST GAS RECIRCULATION (EGR) SYSTEM

BACKGROUND

The present invention is directed to the application and integration of a thermostat in the recycling system of a vehicular exhaust gas recirculation (EGR system). The object of the present invention is to control the temperature of both exhaust gas and engine oil, by means of the placement of a thermostat between an oil/water heat exchanger and a water/exhaust gas exchanger, based on the most advanced technology principles, and the most modern engineering concepts, in accordance with the required norms and specifications, ensuring the best engine performance in relation to the performance and control of pollutant emissions to the atmosphere.

The gas and oil temperature control, which is achieved by balancing the cooling-liquid flow through the oil/water and exhaust gas/water coolers, also aims to avoid gas condensation, in order to facilitate the gas conduction through the pipes, heat exchanger and EGR valve, while also ensuring good engine lubrication performance and gas recycling performance, as well as the combustion and control of pollutant emissions, respectively.

Good performance of the oil cooler consists of controlling the respective oil temperature through a thermal balance and the oil heat loss and gain, thus ensuring the optimum fluid dynamic characteristics for good lubrication.

Good performance of the exhaust gas cooler consists of controlling the respective gas temperature through a thermal balance and the gas heat loss and gain, thus ensuring the fluid dynamics and thermodynamic characteristics for good combustion and control of pollutant emissions.

Thus, one embodiment of the present invention comprises a thermostat integrated to the oil exchanger set which provides economic and technical gains (i.e., better conditions of mounting capacity, functionality, durability, costs, etc.), and also takes into account the customization, since it allows the elimination of components, such as a cover, flange and sealing ring, which are substituted by the integrated thermostat of the invention.

BRIEF DESCRIPTION OF THE DRAWINGS

The following detailed description will be better understood by reference to the accompanying drawings, wherein.

DETAILED DESCRIPTION OF THE INVENTION

Figure 1C:
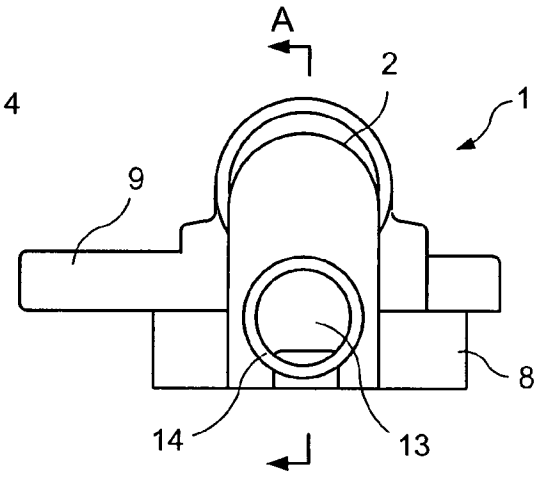
FIGS. 1*a, b, c* and *d* represent a thermostat that is applied to an exhaust gas recirculation (EGR) system, which is seen in side elevation view (1*a*), and by the front view (1*b*), rear view (1*c*) and plan view (1*d*).
Figure 1A:
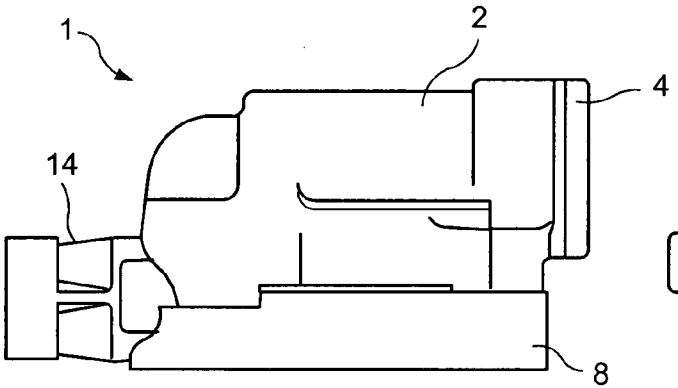
Figure 1B:
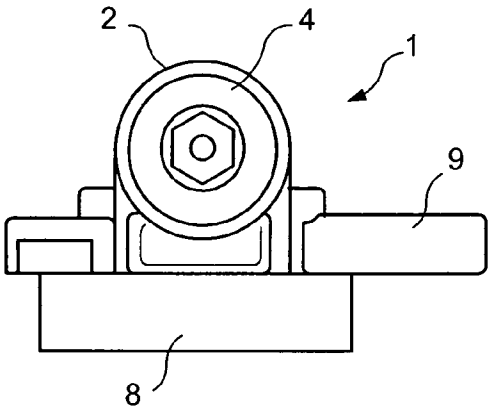
Figure 1D:
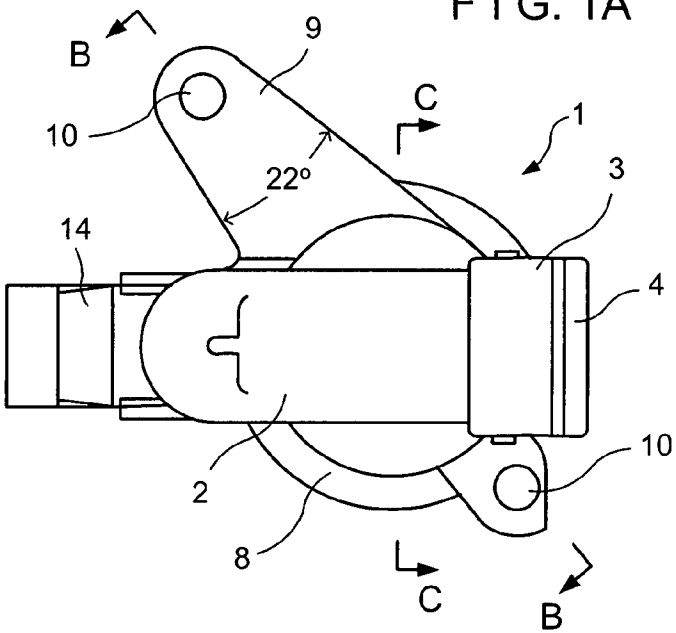
Figure 3:
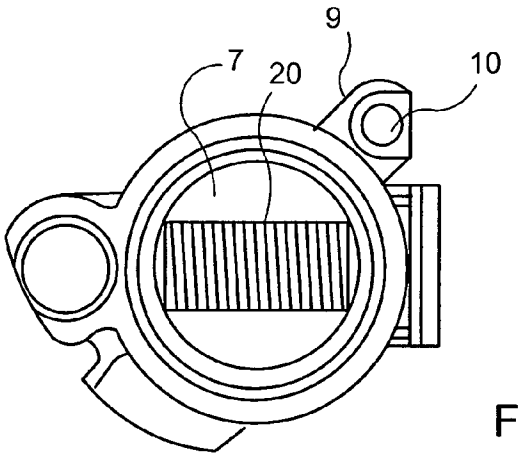
FIG. 3 represents a bottom view of the thermostat.
Figure 4B:
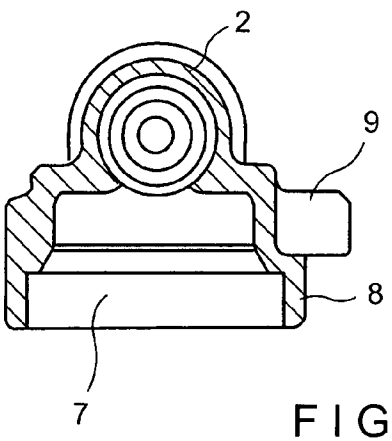
FIGS. 4*a* and 4*b* represent cross-sectional views taken along lines B—B and C—C, respectively, of FIG. 1.
Figure 2:
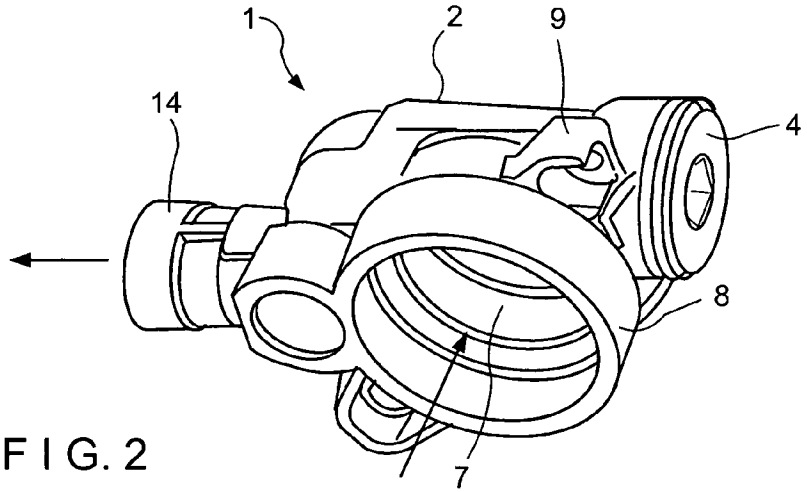
FIG. 2 represents a perspective view of the thermostat.
Figure 4A:
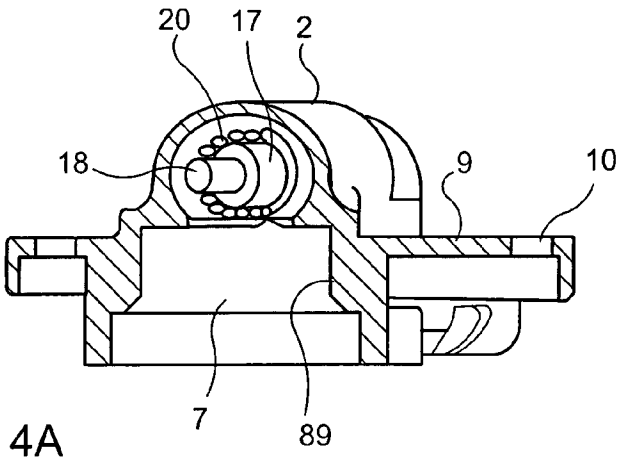
Figure 5:
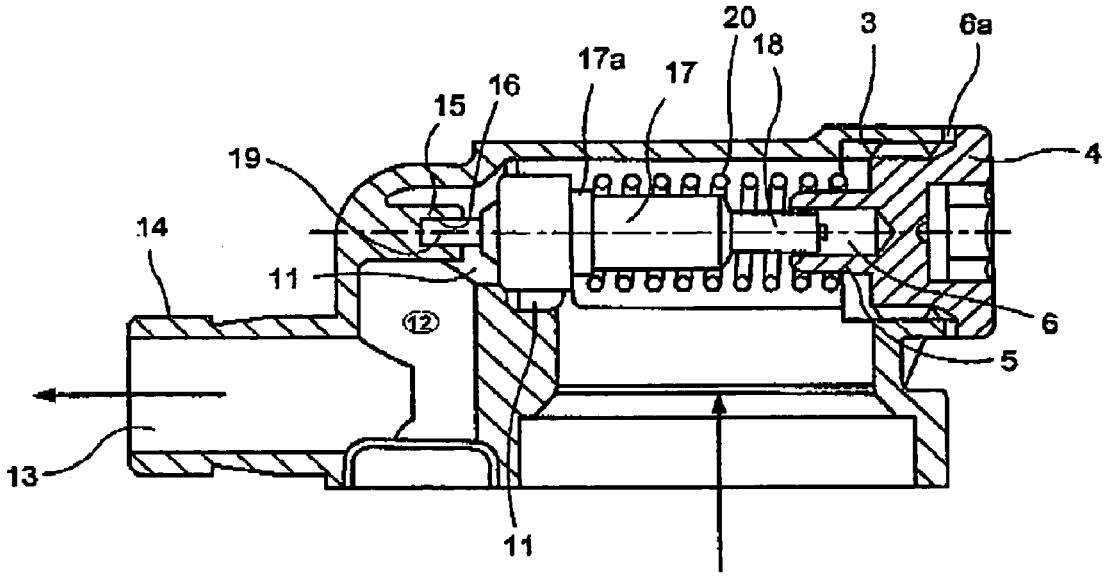
FIG. 5 represents a cross sectional view of the thermostat, enlarged in relation to the other figures taken along line A—A of FIG. 1.
Figure 6:
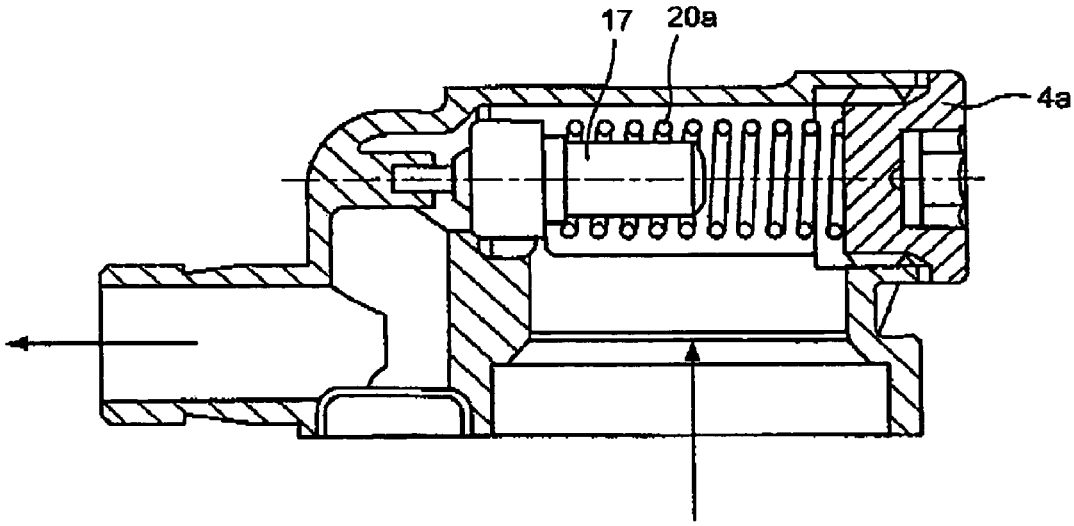
FIG. 6 represents a cross sectional view enlarged in relation to the other figures of an alternative embodiment of the thermostat housing cover.

In accordance with the present invention, and shown in FIGS. 1, 2, 3, and 4, as well as their particular details, a casing is used to integrate a thermostat in a vehicular exhaust gas recirculation (EGR) system which is essentially characterized by the fact that it comprises a part having a multifaceted body (1), in which there is a tubular portion (2) that defines a thermostatic valve housing. Referring to FIGS. 5 and 6, the thermostatic valve housing has a threaded nozzle (3) to allow fixing of a closing/sealing terminal (4) thereto. The terminal (4) has a central projection (5) containing a centered blind hole (6), and is mounted to the thermostatic valve housing with an intermediary sealing ring (6*a*).

The tubular portion (2) provides access to a chamber (7) surrounded by a ring wall (8).

Figure 13:
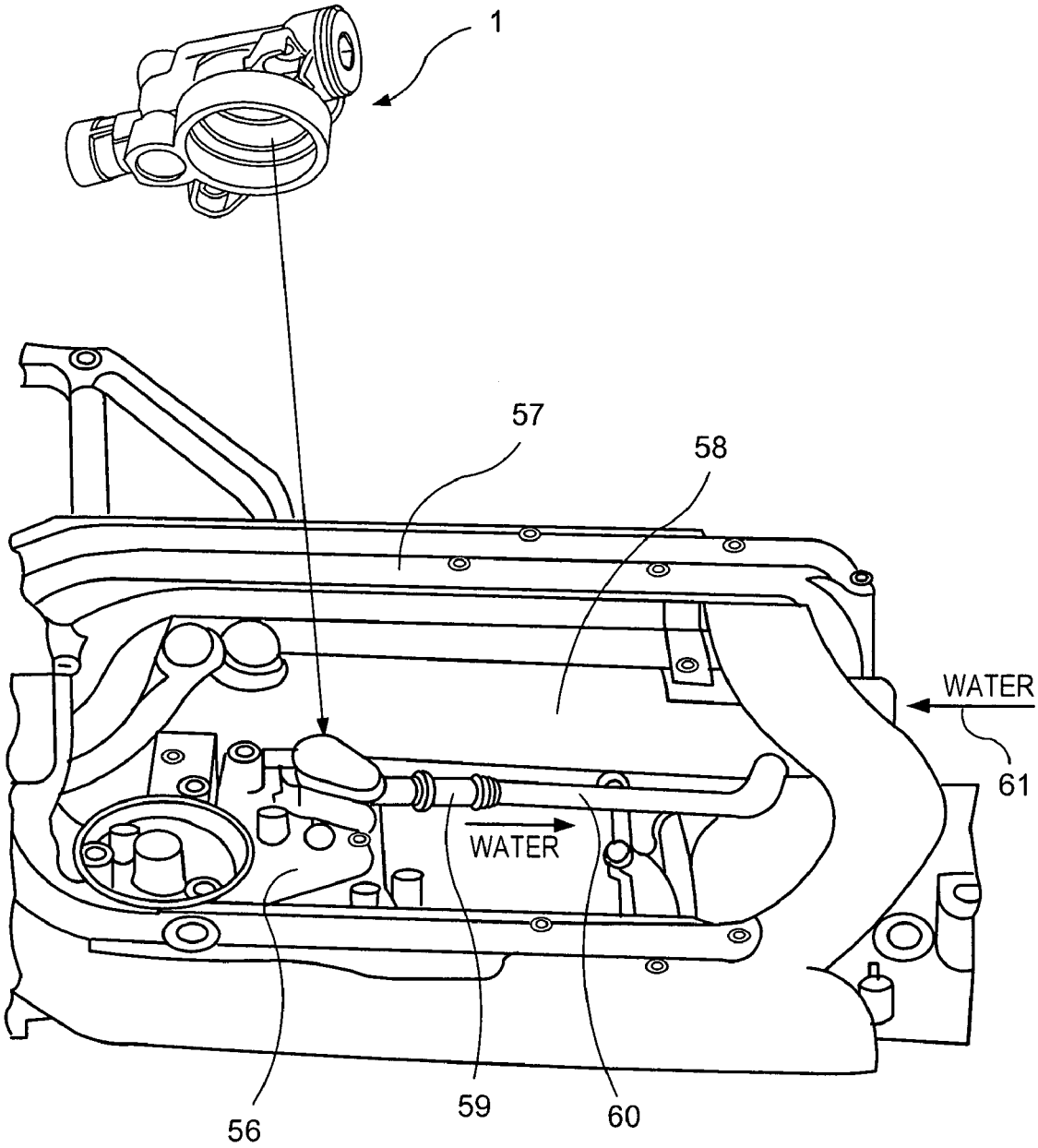
FIG. 13 represents a perspective view of the thermostat positioned to couple the oil heat exchanger system.

The ring wall (8) forms an inlet nozzle (8*a*), on which there is a shaped flange (9) provided with holes (10) designated to receive fixing screws to fix the thermostat to the recycling system of the vehicular exhaust gas recirculation (EGR) system, as exemplified in FIG. 13. From this FIG. 13, it is possible to see a head of an oil heat exchanger head (56), an air collector (57), a gas/water heat exchanger (58) and a quick connect coupling (59) for connecting the body (1) to a water conduit (60). A water inlet to the gas/water heat exchanger is indicated by an arrow (61), the water supplied from a radiator (not shown).

At the bottom of the chamber (7) and aligned with a central axis of the tubular portion (2), there is a smaller diameter by-pass passage (11), through which the chamber is linked to a connection duct (12), providing access to an output channel (13) that is projected along a tubular projection (14).

At the bottom of the smaller diameter by-pass passage (11), there is a cylindrical-shaped central projection (15), having a blind hole (16) to support a central pin (19) of a thermostatic valve.

The thermostatic valve is integrated to the casing (1) by means of its placement inside the chamber (7) along the tubular portion (2), which can be better understood by reference to the cross section view along the line A—A, illustrated in FIG. 5, so that a single set comprising the casing with integrated thermostatic valve is achieved.

The thermostatic valve itself does not necessarily constitute a characterization element of the present invention, wherein the thermostatic valve is included and discussed here solely for illustrative purposes, as an example of mounting and integration. The thermostatic valve comprises a working element or a temperature sensor (17) having an end with a smaller diameter cylindrical extension (18) that serves as a guide element to orientate the thermostat towards the inside of the chamber (7), as well as an opposing end having a central pin (19). Such valves are known for use where temperature is used to control a flow of fluid thereby.

As seen in FIG. 5, the cross-sectional view along A—A, the thermostatic valve that is integrated to the casing is mounted in such way that the lesser diameter cylindrical extension (18) is inserted into the hole (6) located on the top of the central projection (5) of the closing/sealing terminal (4) coupled to the end of the tubular portion (2) of the casing. The centering of the thermostatic valve is determined by inserting the center pin (19) in the blind hole (16) located in the central cylindrical projection (15) in the bottom of the lesser diameter by-pass passage (11) of the casing.

The thermostatic valve is subject to the action of a spring (20) that is supported by one side, under a blockage area of the working element (17*a*); and, on the other side, is supported by the surrounding area of the central projection (5) of the closing/sealing terminal (4) coupled to the end of the tubular portion (2) of the casing.

An alternative embodiment, shown in FIG. 6, is achieved by eliminating the central projection (5) and its respective blind hole (6), and substituting a conical spring (20*a*) and a cylindrical closing/sealing terminal (4*a*) provided with a groove to receive the sealing ring, whose mounting is accomplished using a snap ring or a pressed ring.

If this alternative embodiment is used, the lesser diameter cylindrical extension (17) of the thermostatic valve is sustained or supported on the conical spring (20*a*).

Figure 14:
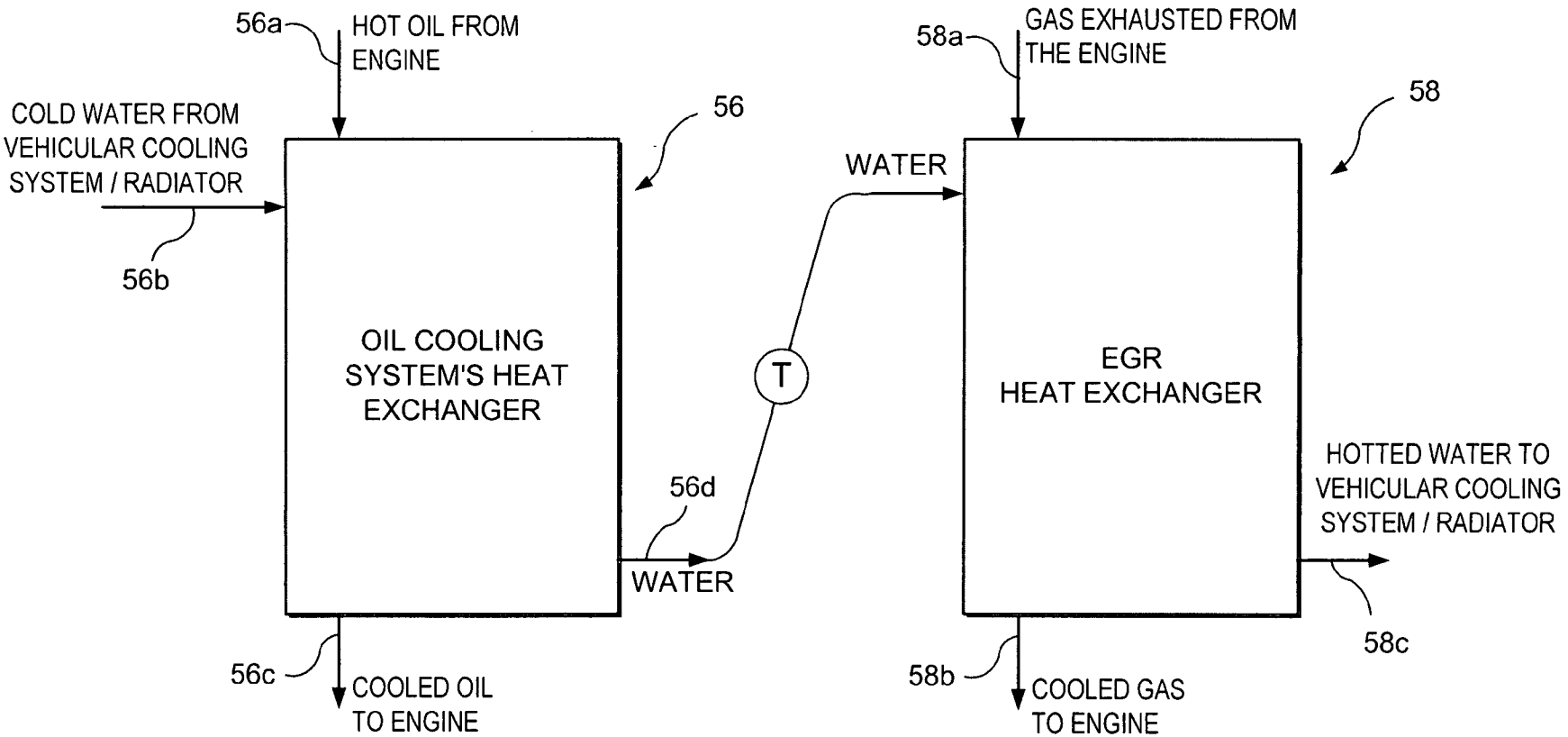
FIG. 14 represents a schematic view of the engine cooling system.

In a basic and general way, as represented by the schematic view shown in FIG. 14, the engine's hot oil enters into the oil cooling system's heat exchanger (5) at arrow (5*a*), where cold-water from a vehicular cooling system/radiator also enters at arrow (5*b*). Such cold-water removes heat from the oil, and, consequently, the oil flows away from the heat exchanger and returns to the engine at 5*c* with an ideal working temperature.

After the heat is removed from the oil, the water heated by the oil leaves the heat exchanger at arrow (5*d*) traveling to the EGR system's heat exchanger (58). Relative to the exhaust gas temperature, the water is still relatively cool, such that the hot gases exhausted from the engine are cooled in this EGR heat exchanger entering at arrow (58*a*) and return to the engine at (58*b*) with a lesser volume and a greater amount of mass. Thus, the combustion will be better, resulting in an exhaust that is cleaner and has less pollutants. After removing the heat from the exhaust, the hotter water returns to the vehicular cooling system/radiator at arrow (58*c*), where it is air cooled for return through the circulation system. This thermostat controlled system provides cooling only when the engine is hot to promote rapid heating to optimize efficiently, and then cooling the oil and recirculated exhaust for optimized performance during normal operating conditions.

Figure 7C:
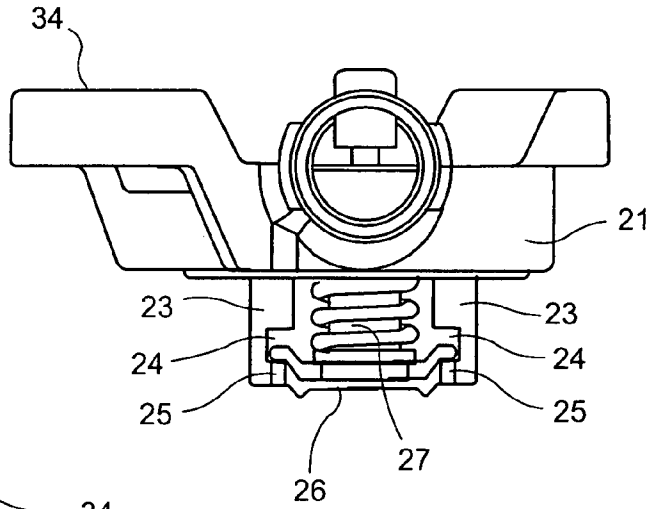
FIGS. 7*a, b* and *c* represent anterior, posterior and side views of an alternative embodiment of the thermostat, respectively.
Figure 7A:
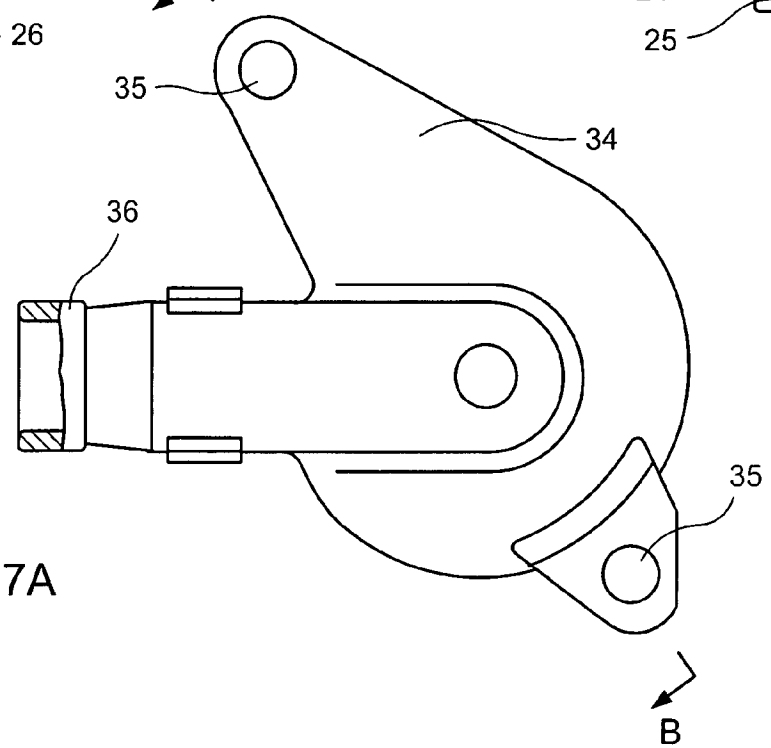
Figure 7B:
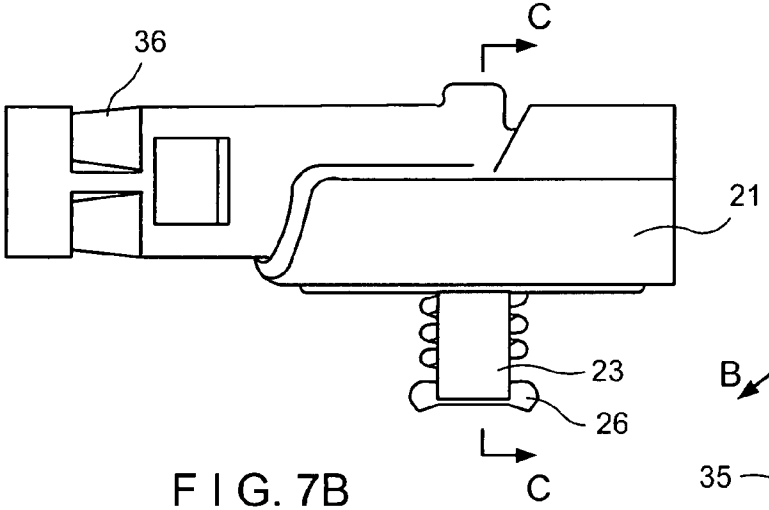
Figure 8:
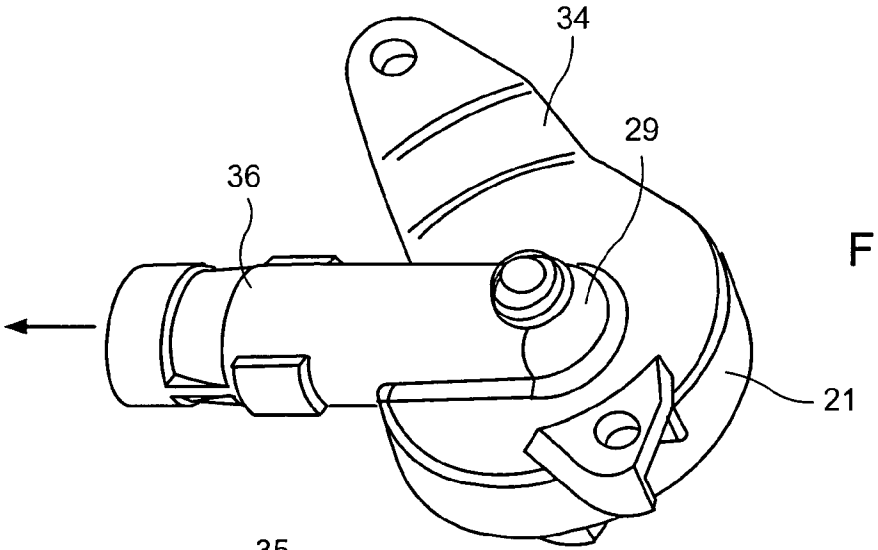
FIG. 8 represents a perspective view of the alternative embodiment of FIG. 7.
Figure 9B:
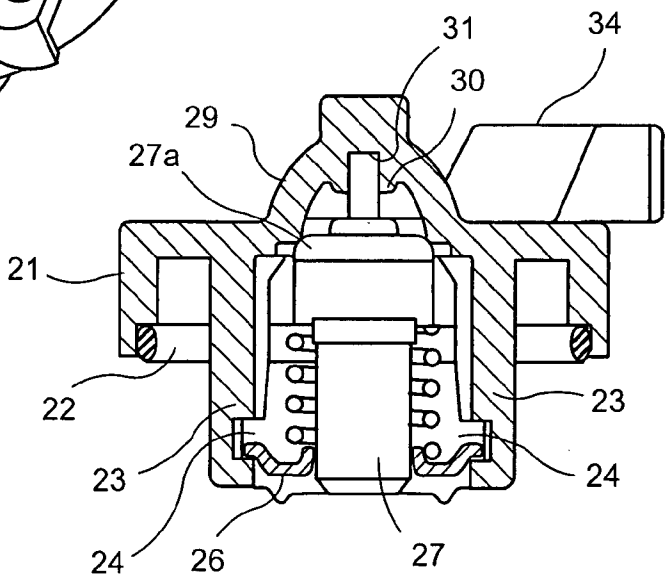
FIGS. 9*a* and *b* represent cross sectional views of the alternative embodiment, according to the drawings shown in FIG. 7 taken along lines B—B and C—C, respectively.
Figure 9A:
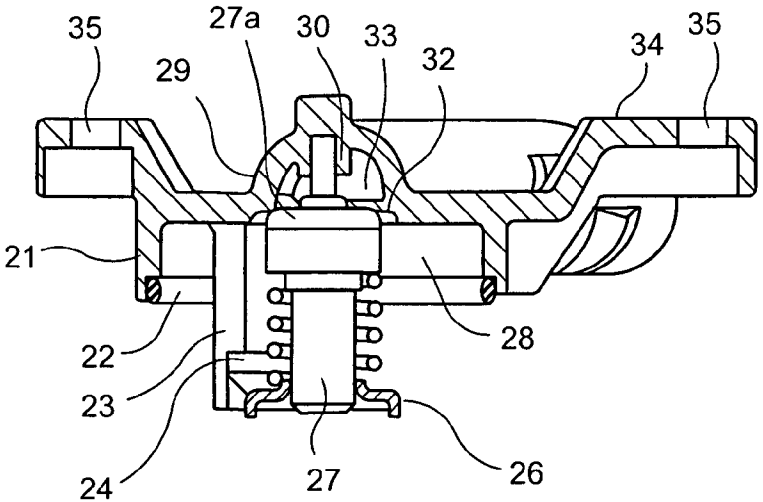

In another embodiment, the thermostat, in accordance with the present invention, is illustrated in FIGS. 7, 8, and 9. This embodiment is characterized by a casing composed of a hollow circular body (21), in whose inlet nozzle is designed a groove (22*a*) to receive a sealing ring (22*b*). At the bottom of the cavity, there are two shaped legs (23) projected perpendicularly, arranged on two diametrically opposing sides. Such legs have a tapered entry angle (25) at the faced ends with a receiving groove (25) to form a rabbet to support the supporting arch (26) of the thermostatic valve (27).

The hollow circular body (21) defines a chamber (28), in which the thermostatic valve is integrated. Above the circular body (21), a convex projection (29) is configured. The convex projection (29) comprises an inner center having, in the tip, a cylindrical projection (30), provided with a blind hole (31) to center the thermostatic valve. Between the body's cavity (21) and the convex projection (29), there is a wall (32) provided with a central opening (33) having a conical or radial edge, to engage a blockage surface (27*a*) of the thermostatic valve, when in the closed position.

Above the circular body (21), a flange (34) is provided with holes (35) designated to receive the fixing screws to fix the integrated set to the oil exchanger casing.

From the convex elevation (29) is projected an outlet tubular extension (36), whose channel is linked to the interior of the convex projection (29).

Figure 10C:
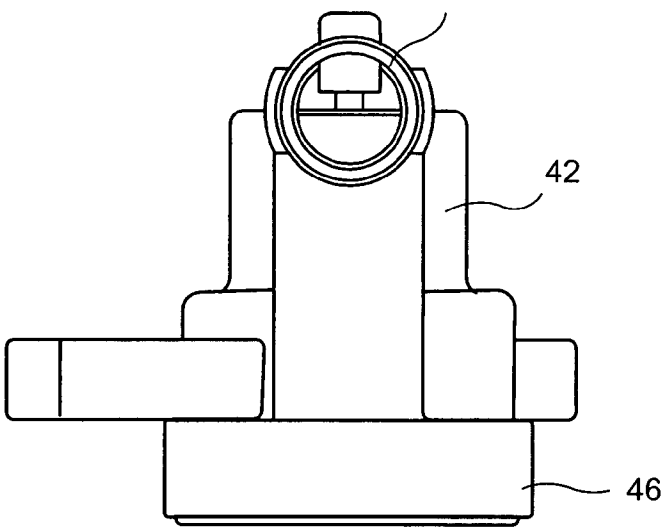
FIGS. 10*a, b* and *c* represent anterior, posterior and side views of a second alternative embodiment of the thermostat, respectively.
Figure 10B:
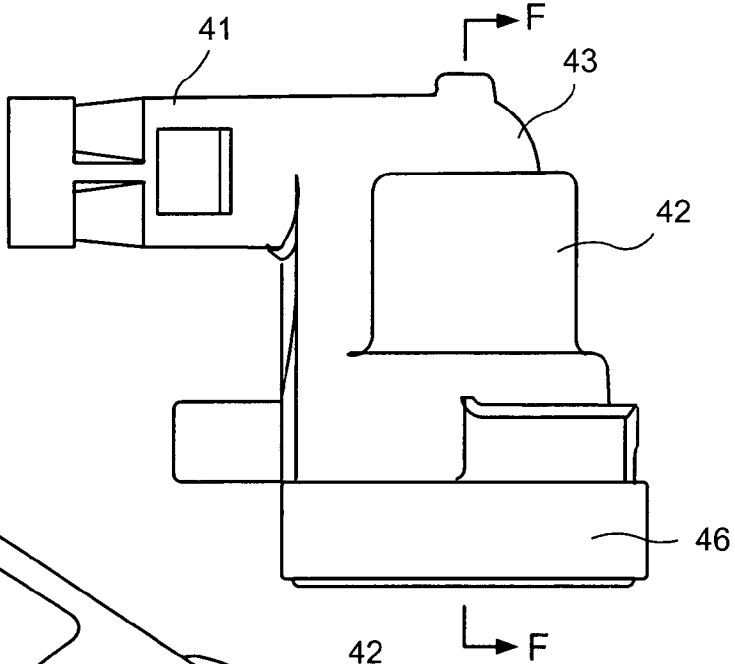
Figure 10A:
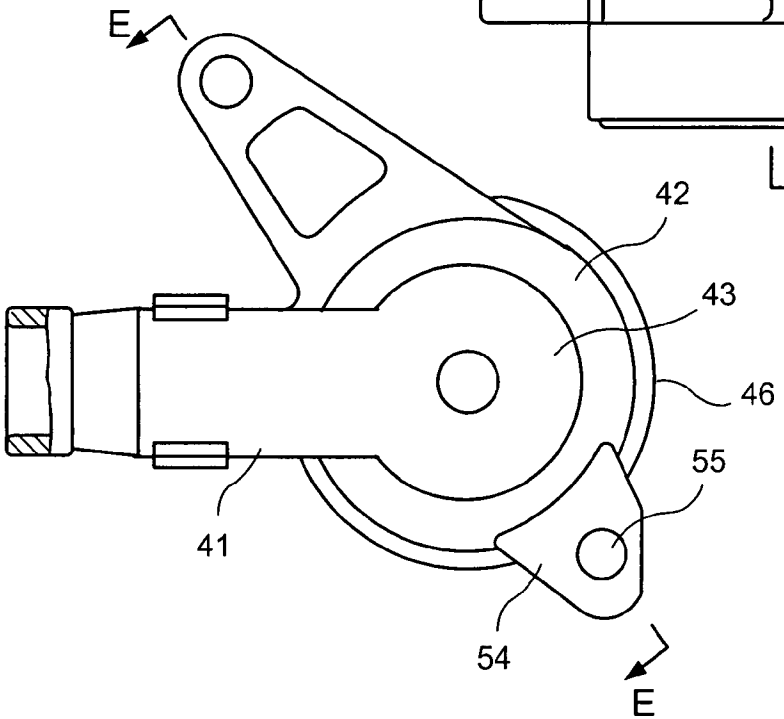
Figure 11:
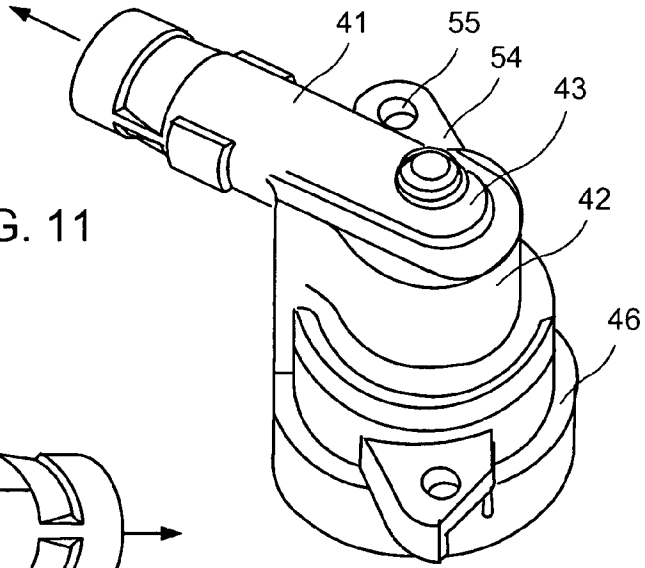
FIG. 11 represents a perspective view of the second alternative embodiment of FIG. 10.
Figure 12B:
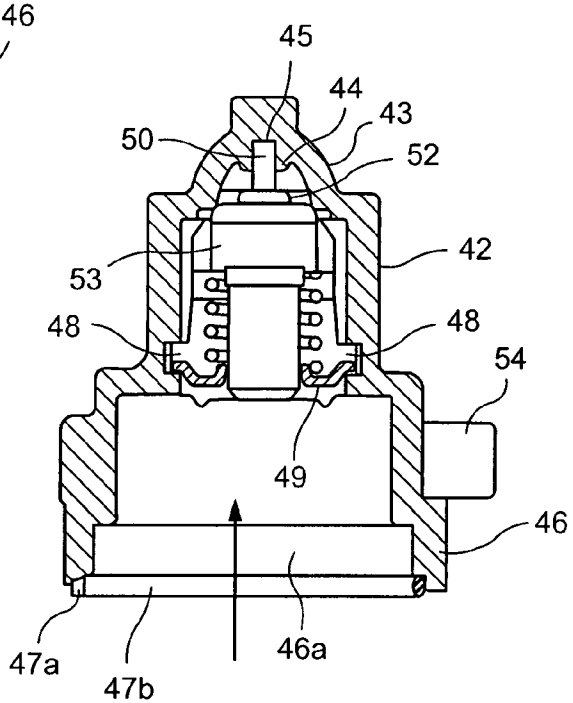
FIGS. 12*a* and *b* represent cross sectional views of the second alternative embodiment, as indicated in FIG. 10 taken along lines E—E and F—F, respectively.
Figure 12A:
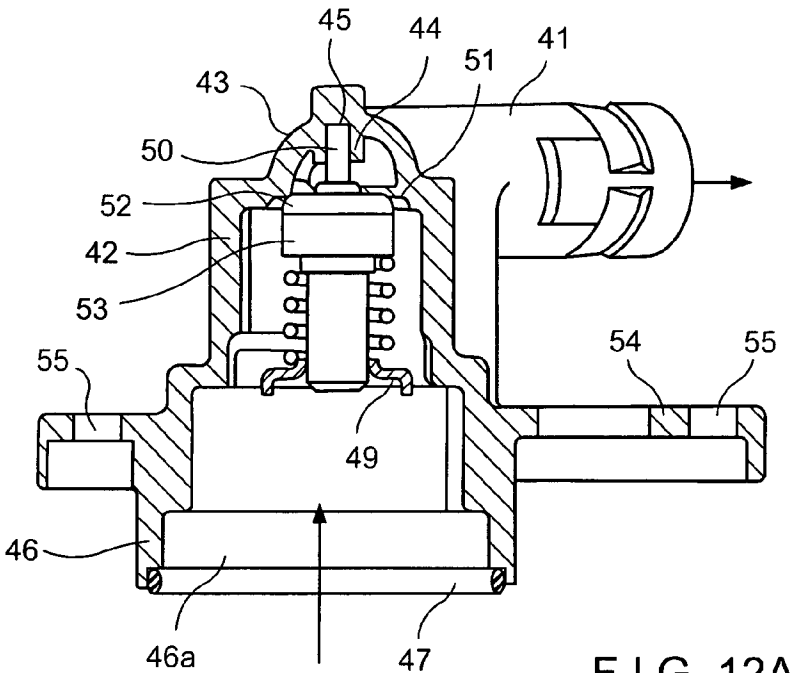

In still another embodiment, the thermostat, in accordance with the present invention, is illustrated in FIGS. 10, 11, and 12. This embodiment is characterized by a casing composed of an outlet tubular extension (41) that diverts to a hollow circular body (42) provided with a superior half-spherical shaped projection (43) that has a cylindrical projection (44) in its interior. In the tip, the cylindrical projection (44) has a blind hole (45) to center the thermostatic valve. The hollow circular body (42) has a bigger diameter extension (46) whose cavity has two dimensions, and an inlet nozzle (46*a*) that is provided with a groove to receive (47*a*) the sealing ring (47*b*).

At the nozzle of the hollow circular body is projected a notch (48) on two diametrically opposing sides to form a rabbet to support the supporting arch (49) of the thermostatic valve therein, wherein the central pin (50) is inserted into the blind hole (45) located in the tip of the cylindrical projection (44) that is defined internally to the half-spherical shaped projection (41).

Between the body's cavity (42) and the half-spherical shaped projection (43), there is a wall (51) provided with a central opening having a conical or radial edge (52), wherein the blockage area of the thermostatic valve (53) is engaged.

Around the bigger diameter extension (46), there is a flange (54) provided with holes (55) for receiving fixing screws that fix the set of thermostat and casing to the casing of the EGR system.

Figure 15A:
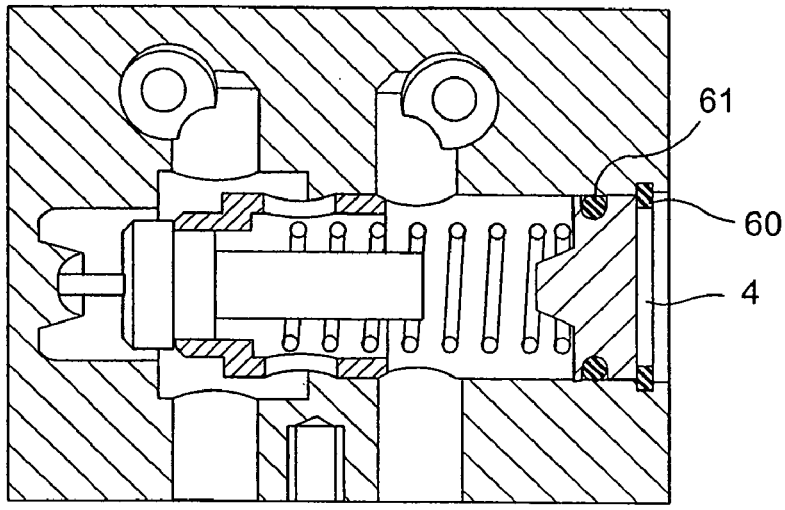
FIGS. 15*a, b* and *c* represent three cross sectional views, showing varied ways of fixing/sealing the closing plug to the thermostat housing.
Figure 15B:
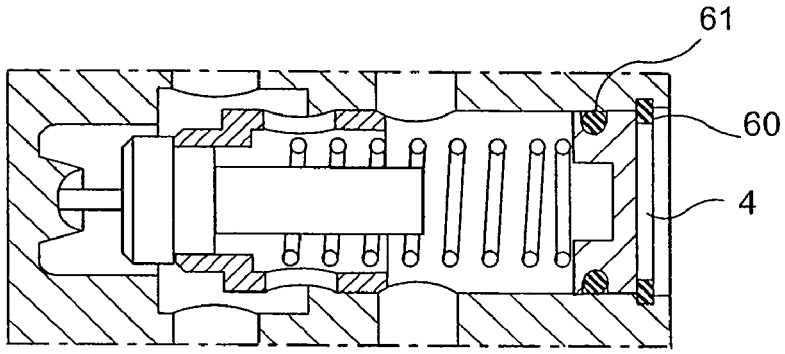
Figure 15C:
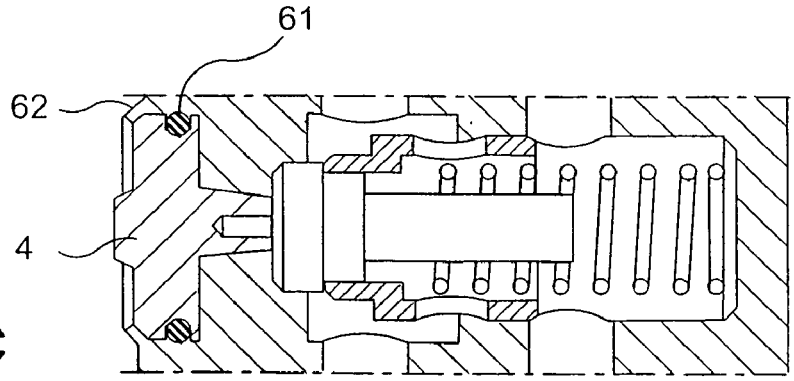

The fixing of the closing/sealing terminal (4) to the thermostatic valve housing can be made in several ways, for example, as shown in FIGS. 5 and 6, followed by threading the terminal over the threaded nozzle of the casing (FIG. 5) or using a snap ring or a pressed ring (FIG. 6); or using an elastic ring (60) with joint sealant (61), as shown in FIGS. 15A and B; or by means of re-spiking (62), as illustrated in FIG. 15C, etc.

Therefore, the application and the integration of a thermostat in the EGR system in order to cool the recycled vehicular exhaust gas using water displaced from an engine oil cooler has been achieved, while satisfying the considered objectives, fulfilling in a practical and efficient way the designated functions, providing a series of advantages inherent to its applicability, as well as proper and innovative characteristics, meeting the fundamental requirement of novelty.

While preferred embodiments of the present invention have been shown and described, it will be understood by those skilled in the art that various changes or modifications can be made without varying from the present invention.

What is claimed is:

1. A thermostat assembly for integration in an exhaust gas recirculating system of a vehicle comprising:

a casing having a coolant inlet nozzle and a coolant output channel, and having a multifaceted body having a tabular portion which defines a thermostatic valve housing, a nozzle for fixing a closing/sealing terminal having a central projection containing a centered blind hole, the tubular portion providing access to a chamber having a ring wall forming the coolant inlet nozzle and supporting a shaped flange having holes for receiving screws therein, a smaller diameter by-pass passage located at a bottom of the chamber and aligned with a central axis of the tubular portion for linking the chamber to a connection duct for providing access to the coolant output channel projected along a tubular projection, a cylinder shaped central projection located at a bottom of the smaller diameter bypass passage having a tip having a blind hole.

2. The thermostat assembly of claim 1 wherein the thermostatic valve is placed inside the chamber, along the tubular portion with the lesser diameter cylindrical extension inserted in the centered blind hole, the center pin inserted in the tip blind hole, the thermostatic valve biased by a spring.

3. The thermostat assembly of claim 1 wherein the nozzle of the tubular portion is fixed by a snap ring or pressed ring to a cylindrical terminal having a groove for receiving a sealing ring therein.

4. The thermostat assembly of claim 1 wherein the lesser diameter extension is supported on a conical spring.

5. The thermostat assembly of claim 1 wherein the thermostat has a hollow body having an inlet nozzle having a groove for receiving a sealing ring, two shaped legs projecting perpendicularly from a bottom of the cavity, the legs arranged on two diametrically opposing sides to form a rabbet to support a supporting arch of the thermostatic valve, the cavity defining a chamber for receiving the thermostatic valve, a convex elevation having an inner central opening having a conical or radial edge for supporting a blockage area of the thermostatic valve, a wall provided between the body's cavity and the convex elevation having a central opening having a conical or radial edge for supporting a blockage area of the thermostatic valve, a flange located above the circular body having holes for receiving fixing screws, an outlet tubular extension projected from the convex elevation having a channel linked to an interior of the convex elevation.

6. The thermostat assembly of claim 1 wherein the thermostat has a tubular extension for diverting to a hollow circular body provided with a half spherical shaped elevation having a cylindrical projection in an interior thereof, and having a blind hole in a tip thereof to center the thermostatic valve, the hollow circular body having an extension and an inlet nozzle with a groove to receive a sealing ring, a declivity projected at the nozzle for forming a rabbet to support a supporting arch of the thermostatic valve, wherein a central pin is inserted in the blind hole, a wall between the body's cavity and the half spherical shaped elevation having an opening having a conical or radial edge for supporting a blockage area of the thermostatic valve, a flange around the extension having holes for receiving fixing screws therein.

7. The thermostat assembly of claim 1 wherein the closing/sealing terminal is fixed to the thermostatic valve housing by a structure selected from the group consisting of threads, a snap ring, a pressed ring, an elastic ring with joint sealant or by re-spiking.

* * * * *